United States Patent [19]

Nishiguchi

[11] 4,385,647

[45] May 31, 1983

[54] WARP STOP MOTION

[75] Inventor: Narachiyo Nishiguchi, Osaka, Japan

[73] Assignee: Nishiki Sangyo Kabushiki Kaisha, Osaka, Japan

[21] Appl. No.: 238,610

[22] Filed: Feb. 26, 1981

[30] Foreign Application Priority Data

Mar. 4, 1980 [JP] Japan ..... 28524
Mar. 5, 1980 [JP] Japan ..... 29311

[51] Int. Cl.[3] ..... D03D 51/28
[52] U.S. Cl. ..... 139/369
[58] Field of Search ..... 139/369, 358

[56] References Cited

U.S. PATENT DOCUMENTS

| | | | |
|---|---|---|---|
| 951,487 | 3/1910 | Regan | 139/369 |
| 2,322,385 | 6/1943 | Payne | 139/369 |
| 2,479,546 | 8/1949 | Thatcher et al. | 139/369 |
| 3,584,659 | 6/1971 | Pfarrwaller | 139/369 |

*Primary Examiner*—Henry Jaudon
*Attorney, Agent, or Firm*—Hall & Houghton

[57] ABSTRACT

A warp stop motion of the dropper type for automatically stopping the loom associated therewith upon breakage of a warp yarn, including a pair of side frames, each of which doing away with conventional T-shape, is of inverted L-shape comprising a horizontal arm portion for supporting contact bars and separator bars and a vertical arm portion whose upper end joins one end of the horizontal arm portion and whose lower end joins a horizontal shaft. Each side frame has recesses formed in the inner surface thereof for receiving one of the respective ends of the separator bars, and a spring is disposed between one end of each separator bar and the bottom of each recess.

4 Claims, 6 Drawing Figures

WARP STOP MOTION

This invention relates to a warp stop motion, particularly of the dropper type, for automatically stopping the loom associated therewith upon breakage of a warp yarn.

The dropper type warp motion comprises droppers, each being suspended from a warp yarn by making use of the warp yarn tension and between the heald system and the back rest so that when a warp yarn breaks or loosens, the associated dropper falls under its own weight to cause automatic stoppage of the operation of the loom. In a known arrangement of the dropper type, when a dropper falls, an electric circuit is completed by the dropper and a contact bar which catches it, thereby automatically actuating a device which stops the loom. The plurality of contact bars are transversely supported between a pair of opposed side frames across the path of travel of the warp yarns.

Conventionally, the side frame is of T-shaped construction in which the base at which it is attached to a support shaft is located at the lower portion of the central vertical branch, namely, the front end of the leg of the T. As a result of this construction, the front guide tube, which serves as a positional reference for attachment of the device, can hardly be correctly set vertically and horizontally and tends to deviate from the correct position. Consequently, the contact bar row and separator bar row, which should be horizontal, tend to be inclined, thus occasioning the malfunction of the droppers when warp yarns break.

Besides, the separator bars, which are disposed below the contact bar row and serve to separate adjacent droppers from each other, have been supported at their opposite ends in bearing portions projecting from the inner surfaces of the side frames. Between the opposed side frames, therefore, these projecting bearing portions form an obstacle which correspondingly decreases the number of droppers which can be suspended. Thus, the bearing portions have defined useless space portions with respect to the effective width of the loom.

This invention contemplates to provide a warp stop motion of the type described, which can be correctly and easily installed and whose vertical and horizontal positions can be quickly and easily adjusted according to changes in the length of the back rest, which changes are made so as to accord with the kind of the fabric to be woven or to adjust the handling of the fabric.

Another object of the invention is to provide a warp stop motion of the type described, which affords as long a distance between the opposed side frames as the effective width of the loom so as to make it possible to install as many droppers as possible.

According to the present invention, the side frame is L-shaped, in other words, is inverted L-shaped with the lower end serving as a point of attachment to the horizontal shaft, so that the front guide tube is positioned substantially above the pivotal point, which means that the positioning of the front guide tube is very easy. Thus, since the present device is simple in construction and can be easily installed, it is applicable to a wide variety of looms and very practical.

Further, in the present device, the separator bar attaching portions are in the form of recesses formed in the inner surface of the side frame. As a result, the inner surface of the side frame is a vertical plane surface throughout, so that the space between the opposed side frames has the same distance as the effective width of the loom, thus making it possible to install as many droppers as possible. Further, the construction is simple and remodeling of the existing devices, let alone the production of fresh devices, can be carried out with ease. The present device allows simple and easy mounting and dismounting of the separator bars and is very practical.

These and other objects and features of the present invention will become more apparent from the following description to be taken in conjunction with the accompanying drawings, in which.

Figure 1:
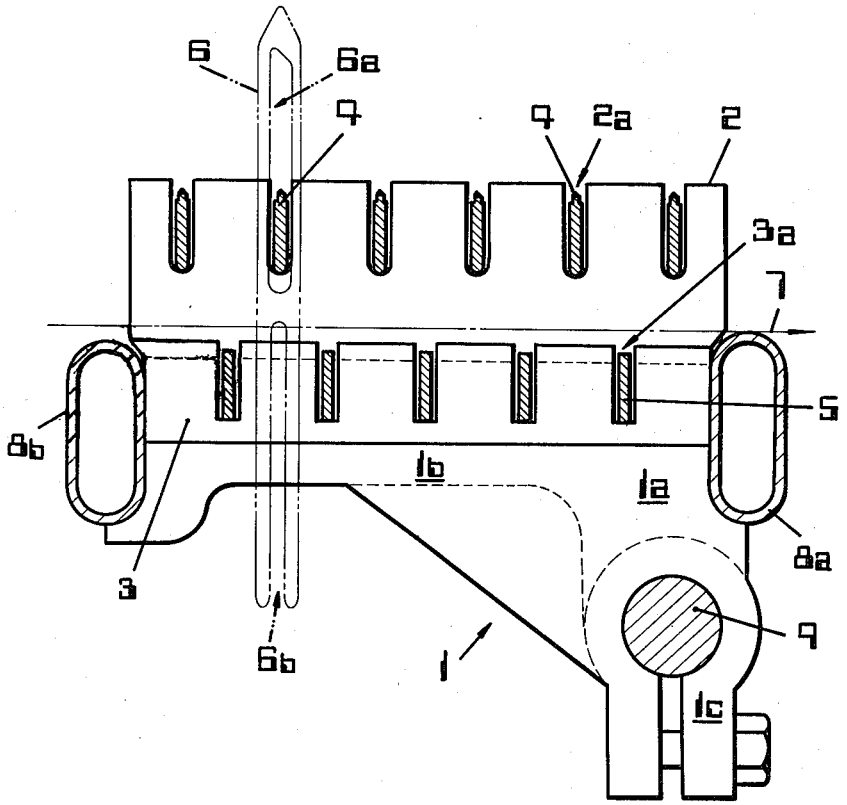
FIG. 1 is a cross-sectional view of a warp stop motion according to an embodiment of the invention.

Referring first to FIG. 1, a pair of side frames 1 (only one of which is visible) are opposed to each other and disposed on both sides of the path of travel of warp yarns indicated by an arrow. Such side frame is an integral combination of a first support plate 2 having a plurality of first notches 2*a* arranged side by side and a second support plate 3 having a plurality of second notches 3*a* arranged side by side. The second notches 3*a* are each arranged below and between adjacent first notches 2*a*. The two side frames 1 each having the notches 2*a* and 3*a* in two rows, upper and lower, are installed on both sides of the machine frame so that the notches 2*a* and 3*a* are respectively opposed to each other, and contact bars 4 are then fitted in the first notches 2*a* of the side frames while separator bars 5 are placed in the second notches 3*a* across the width of the loom. Thus, the contact bars 4 are arranged side by side in the upper row as supported by the opposed side frames 1 while the separator bars 5 are arranged side by side therebelow each between adjacent contact bars 4. Droppers 6 are held at suitable places as indicated in phantom lines.

More particularly, the droppers 6 are loosely fitted on the contact bars 4 by means of their elongated openings 6*a* and separated from each other by the separator bars 5. Each of the warp yarns 7 passing between the row of contact bars and the row of separator bars therebelow is inserted in an elongated opening 6*b* formed in a dropper 6 below the elongated opening 6*a*, so that the warp yarn tension brings the warp yarn into contact with the associated dropper to lift and hold the latter at the necessary height. As soon as a warp yarn breaks, the associated dropper falls and comes in contact with the associated contact bar 4 to electrically energize a loom stopping mechanism (not shown). In addition, guide tubes 8*a* and 8*b* are horizontally installed on the front and rear sides of the opposed side frames 1 so as to guide the warp yarns between the back rest (not shown) and the healds (not shown).

The two side frames arranged in the manner described constitute a dropper assembly. In attaching the assembly to the machine frame, it is necessary to ensure that the warp yarn sheet 7 travels across the two guide tubes 8*a* and 8*b* and between the upper row of contact bars 4 and lower row of separator bars 5. As a reference for attaching the device in this manner, the front guide tube 8*a* is disposed nearer to the fell of the fabric being woven and in contact with the lower side of the warp yarn system 7. Thus, the frames 1 are set horizontal, as usual. The mounting of the droppers is also performed in the usual manner. In the case of a dropper 6 having an elongated opening 6*a* and a warp yarn guide opening 6*b*, for example, the contact bar 4 is loosely inserted in the elongated opening 6*a* and the dropper 6 is suspended at the necessary height by means of the tension on the yarn passing through the guide slot 6*b*.

The opposed side frames 1 are fixed on a support shaft 9 extending across the width of the loom, as shown. The side frames 1 are inverted L-shaped or L-shaped as shown and the lower end of the portion 1*a* associated with the front guide tube 8*a* serves as the base for attachment to the horizontal shaft 9.

As described, the dropper assembly with the two side frames 1 disposed in opposed relation on the shaft 9 at the opposite ends has its shaft 9 supported in brackets mounted on the machine frame, its front guide tube 8*a* held in contact with the lower side of the warp yarn sheet, and its arms 1*b*, which support the contact bars 4 and separator bars 5 in side by side relation, horizontally fixed. Since the side frame 1 is inverted L-shaped with its attaching base 1*c* disposed nearer to the front guide tube 8*a*, it is easy to attach it to the horizontal shaft 9 with its arm 1*a* disposed vertically. Further, since the arm 1*b* which supports the contact bars and separator bars is fixed horizontally, the side frame can be attached to the machine frame quickly and correctly.

Figure 2A:
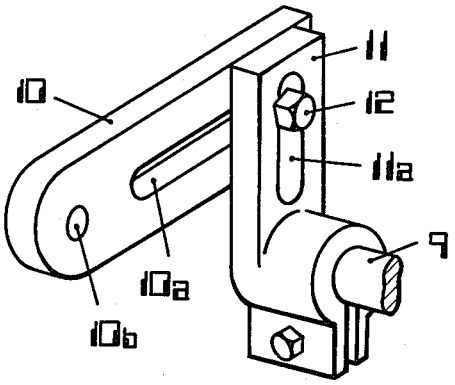
FIG. 2A is a perspective view of a bracket used to adjustably attach the device of FIG. 1 to a loom.
Figure 2B:
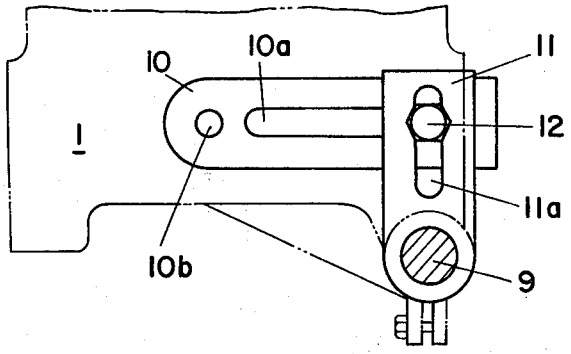
FIG. 2B is a cross-sectional view showing the relation of the bracket and shaft assembly of FIG. 2A to the side frame 1 shown in phantom.

The horizontal shaft 9 can be easily attached to the machine frame by means of brackets shown in FIG. 2 in such a manner that it is slidable vertically and horizontally. Thus, the dropper assembly can be quickly and securely fixed in position by adjusting it in accordance with the back rest whose level can be changed according to the kind of the fabric to be woven. As shown, this bracket comprises an arm 10 which will be attached horizontally to the machine frame by a clamping screw extending through an attaching hole 10*b* and an arm 11 horizontally and vertically adjustably attached to the first-mentioned arm 10. The shaft 9 is attached to the arm 11. In order to slidably attach the arm 11 to the arm 10, the arms 10 and 11 are provided with elongated openings 10*a* and 11*a*, respectively, which are used as slide holes for positional adjustment to receive a screw 12 by which they are clamped together.

Figure 3:
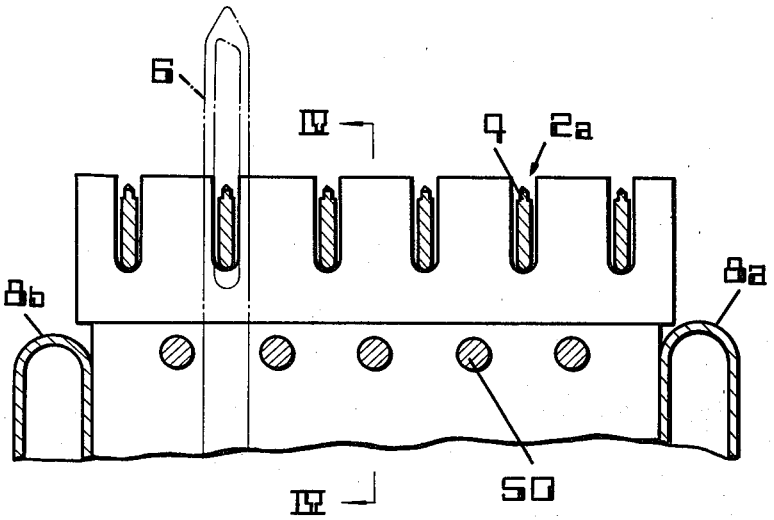
FIG. 3 is a view similar to FIG. 1 but showing a modification of the device shown in FIG. 1.
Figure 4:
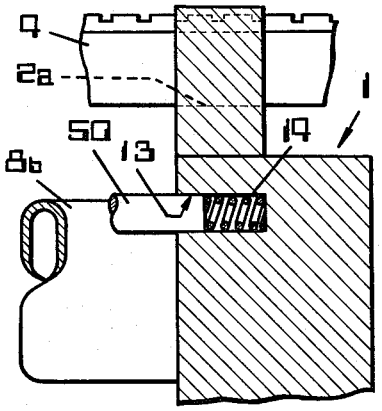
FIG. 4 is a sectional view taken along the line IV—IV of FIG. 3.
Figure 5:
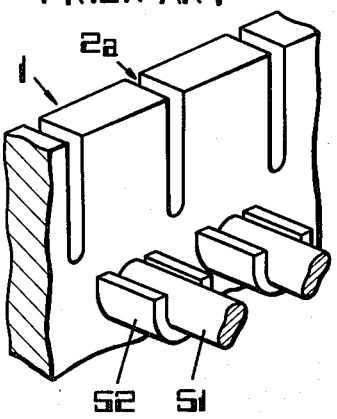
FIG 5 PRIOR ART
FIG. 5 is a perspective view showing separator bar supporting portions of a conventional side frame.

FIGS. 3 and 4 illustrate a concrete example which is capable of securing as long a distance between the side frames as the effective width of the loom without creating any wasteful space so as to install as many droppers as possible. A plurality of attaching holes 13 each having a coil spring 14 received therein are formed in the inner surface of each side frame on the level of the separator bars 50. As a result, the portions for attaching the separator bars 50 is flush with the vertical plane in which notches 2*a* for receiving the the contact bars 4 are formed. The attachment of the separator bars 50 is effected by forcing both ends of the separator bars into the holes 13 while compressing the springs 14. Once the separator bars are inserted, they are held in position stably by the stored energy of the spring 14. In addition, the conventional separator bars 51 have been supported at their ends on bearing portions 52 projecting from the inner surface of the side frame 1, as shown in FIG. 5.

What is claimed is:

1. A warp stop motion for looms comprising a pair of side frames supporting in side-by-side and vertically spaced relation, a plurality of contact bars, a plurality of separator bars holding a number of droppers, a front guide tube and a horizontal shaft extending between said side frames perpendicularly to the direction in which warp yarns pass, each of said side frames being of inverted L-shape with the lower end of the inverted L serving as a base for attachment to said horizontal shaft, and said guide tube being positioned substantially at the corner of the L of said side frames.

2. A warp stop motion as set forth in claim 1, including brackets disposed between said support shaft and the machine frame, each of said brackets comprising a horizontal arm adapted to be joined to said machine frame and having a longitudinally extending elongated opening, a vertical arm supporting at one end thereof said horizontal shaft and having a longitudinally extending elongated opening, and means extending through said elongated openings for clamping said two arms together.

3. A warp stop motion as set forth in claim 1, wherein each of said side frames has recesses for receiving the ends of the separator bars, with a spring disposed between each of said ends and the bottom of each of said recesses.

4. A warp stop motion for looms having a dropper holding section consisting of a plurality of contact bars and a plurality of separator bars, said warp stop motion being characterized in that the inner surface of each of a pair of opposed side frames which support said dropper holding section is provided with a plurality of attaching holes each having a coil spring received therein, both ends of each separator bar being forced into the associated attaching holes of the opposed side frames by compressing said springs so as to support the separator bar.

* * * * *